US007108668B2

(12) United States Patent
Fang

(10) Patent No.: US 7,108,668 B2
(45) Date of Patent: Sep. 19, 2006

(54) BATTERY-OPERATED VIBRATOR FOR SEX TOY

(76) Inventor: Chia-Feng Fang, No. 6, Alley 5, Lane 302, Junghua S. Rd., Sec. 2, Tainan City (TW)

( * ) Notice: Subject to any disclaimer, the term of this patent is extended or adjusted under 35 U.S.C. 154(b) by 91 days.

(21) Appl. No.: 10/999,295

(22) Filed: Nov. 29, 2004

(65) Prior Publication Data

US 2005/0288611 A1 Dec. 29, 2005

(30) Foreign Application Priority Data

Jun. 23, 2004 (TW) ..... 93209929 U

(51) Int. Cl.
*A61H 1/00* (2006.01)
*A61H 19/00* (2006.01)

(52) U.S. Cl. ..... 601/70; 601/46; 601/69

(58) Field of Classification Search ..... 601/46, 601/56–60, 67, 69, 70, 72, 78–81, 84; 600/38
See application file for complete search history.

(56) References Cited

U.S. PATENT DOCUMENTS

| | | | | |
|---|---|---|---|---|
| 5,470,303 | A * | 11/1995 | Leonard et al. | 601/84 |
| 6,790,189 | B1 * | 9/2004 | Kobayashi et al. | 601/70 |
| 6,991,598 | B1 * | 1/2006 | Klein | 600/38 |
| 2004/0068213 | A1 * | 4/2004 | Fujisawa | 601/70 |

* cited by examiner

*Primary Examiner*—Quang D. Thanh
(74) *Attorney, Agent, or Firm*—Alan D. Kamrath; Nikolai & Mersereau, P.A.

(57) ABSTRACT

Provided is a cylindrical vibrator for sex toy. The vibrator has two halves coupled together by snapping. The vibrator comprises a top cavity for receiving a sliding switch, a plurality of compartments wherein any two adjacent compartments are communicated through an groove, an conductive, flexible interconnection fastened on an inner wall and comprising an upper recess having its mouth urged against an inclined portion on a bottom of the switch in a non-operating position, one or more cells coupled in series, and a motor electrically coupled to both the interconnection and the cell. Sliding the switch from the non-operating position to an operating position will press the recess to contact a negative terminal of the below cell for forming a circuit to energize the motor.

4 Claims, 4 Drawing Sheets

BATTERY-OPERATED VIBRATOR FOR SEX TOY

FIELD OF THE INVENTION

The present invention relates to sex toys in general, and relates to a sex toy (e.g., ring) having a battery-operated vibrator with improved characteristics in particular.

BACKGROUND OF THE INVENTION

Currently, vibration type sex toys are popular. This is because it can increase sexual feelings or desires in intercourse. Conventionally, such vibration type sex toys are provided with vibrators operated by batteries. However, current leakage is often caused because the power construction of such sex toys tends to be turned on accidentally. Thus, continuing improvements in the exploitation of drive of vibration type sex toy are constantly being sought.

SUMMARY OF THE INVENTION

It is an object of the present invention to provide a vibrator being mountable in a sex toy and comprising a housing consisting of two halves coupled together by means of a snapping mechanism, one or more cells and a motor. The housing having a cavity on the top comprising a gap on its middle section and a rib on its underside and a plurality of walls for dividing an internal space of the housing into a first compartment, a second compartment, and a third compartment, wherein any two adjacent compartments are communicated through a notch. The vibrator further includes a sliding switch comprising a top knurled button disposed on the cavity, an intermediate narrow section inserted into the gap, and a bottom section disposed in the first compartment, the bottom section having two opposite top projections formed on a shoulder between itself and the narrow section. The vibrator further includes anchoring means formed on an inner wall of the second compartment; an conductive, flexible interconnection comprising an upper contacting section having a portion urged against an inclined portion on the bottom section of the switch in a non-operating position, and a main section fastened by the anchoring means. The cells are coupled in series and disposed in the second compartment and the motor is disposed in the third compartment and has a positive terminal electrically coupled to the interconnection and a negative terminal electrically coupled to the positive terminal of the proximate cell. Whereby, sliding the switch from the non-operating position to an operating position will press the contacting section to contact a negative terminal of the below cell for forming a circuit to energize the motor and engage the projections with the rib for fastening the switch.

In one aspect of the present invention, the anchoring means comprises a longitudinal projection formed on the inner wall of the second compartment, the projection having a longitudinal trough, and a protrusion formed on an inner wall of the third compartment below the projection by a distance.

In another aspect of the present invention, the main section of the interconnection comprises a bent bottom urged against the protrusion.

In a further aspect of the present invention, the snapping mechanism comprises a first bar, an opposite first tube with the first bar received therein both in the first compartment, a second bar, and an opposite second tube with the second bar received therein both in the fourth compartment.

The above and other objects, features and advantages of the present invention will become apparent from the following detailed description taken with the accompanying drawings.

DETAILED DESCRIPTION OF THE PREFERRED EMBODIMENTS

Figure 1:
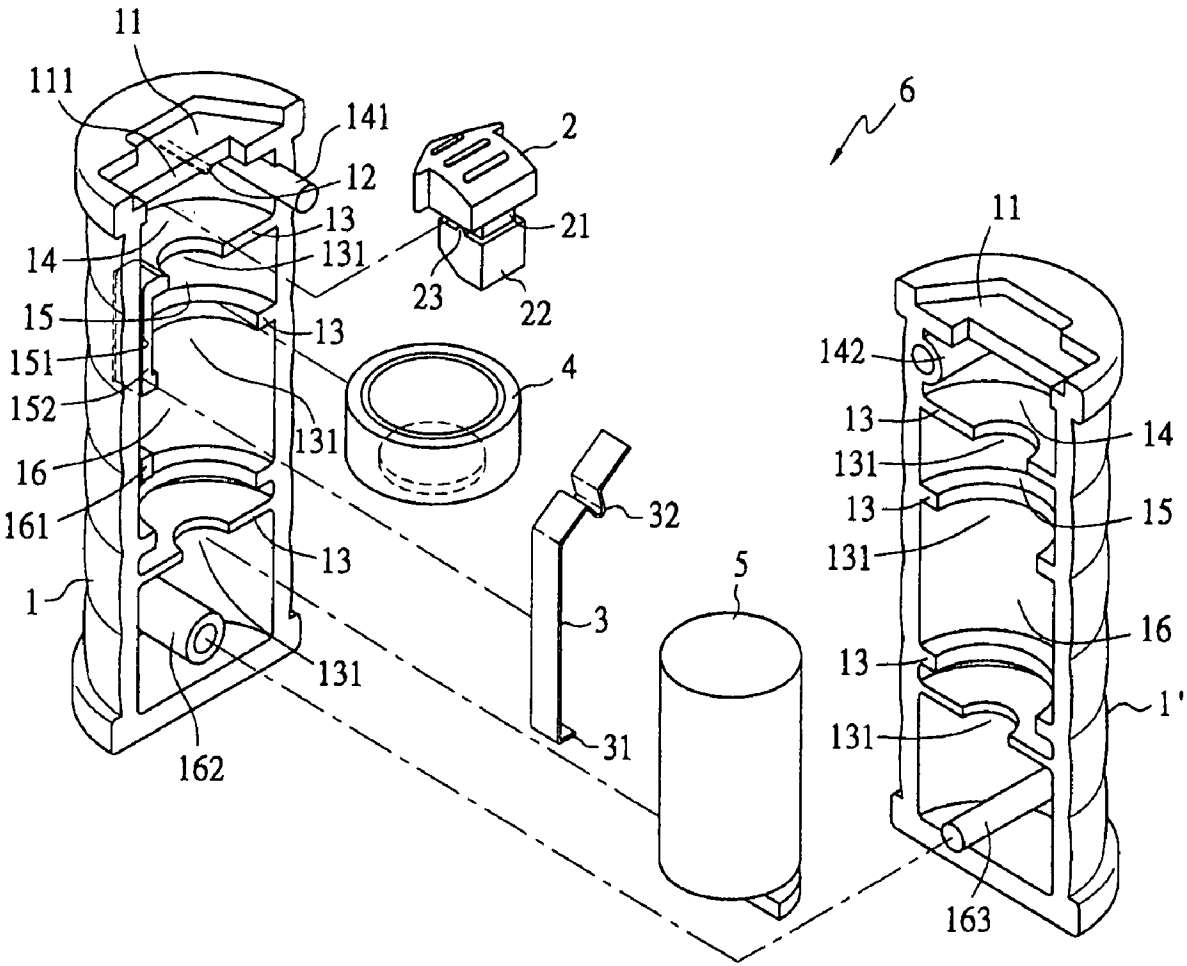
FIG. 1 is an exploded view of a preferred embodiment of vibrator mountable in a sex toy according to the invention.

A vibrator 6 in accordance with a preferred embodiment of the invention mounted in a sex toy, as shown in FIG. 1, is a substantially cylindrical housing consisting of a first shell-circular shell 1 and a second shell-circular shell 1'. A sliding switch 2, a conductive, flexible interconnection 3, a disc shaped cell 4 and a motor 5 are assembled inside the housing.

The housing has a cavity 11 on the top, said cavity has a rectangular gap 111 on a middle section. The first shell 1 has a rib 12 formed on an underside of the cavity 11. A plurality of walls 13 each having a notch 131 of a predetermined size are formed inside the first shell 1 for dividing the internal space of the housing into at least a first compartment 14, a second compartment 15, and a third compartment 16 between each adjacent pair of walls 13. In the first compartment 14 a lateral bar 141 is formed proximately on the peripheral edge. In the second compartment 15, a stopper 152 is formed on an opposite edge relative to the lateral bar 141 and has a longitudinal trough 151 for prevent the interconnection 3 contacting the cell 4 directly. In the third compartment 16, a protrusion 161 is formed on an inner wall of the third compartment 16 below the stopper 152 by a distance, and a sleeve 162 is formed near a lower portion. The second shell 1' has a plurality of walls 13 located corresponding to those of the first shell 1, each wall 13 having a notch 131 of a size according to a corresponding one of the first shell 1. An sleeve 142 is formed in the first compartment 14 of the second shell 1' for snuggly receiving the bar 141. A bar 163 extends in the third compartment 16 of the second shell 1' for snuggly being received by the sleeve 162 of the first shell 1. In brief, the first and second shells 1 and 1' form the housing by snapping.

A sliding switch 2 comprises a top knurled button disposed on the cavity 11, an intermediate narrow section 21, and a bottom section 22 disposed in an upper portion of the first compartment 14, the bottom section 22 having two opposite top projections 23 formed on a shoulder between itself and the narrow section 21.

The conductive, flexible interconnection 3 comprises an upper contacting section 32, a main section and a bent bottom section 31.

Figure 3:
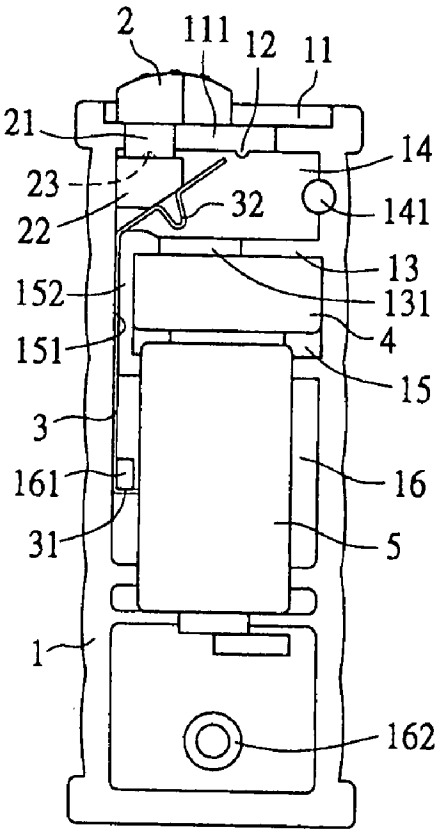

In assembly, referring to FIG. 3, the intermediate narrow section 21 is disposed into the gap 111 of the first shell 1, then the interconnection 3 is inserted into the trough 151 so as to be against the stopper 152 and thus the bottom section 31 is urged against the protrusion 161. As an end, the interconnection 3 is fastened. The disc-shaped cell 4 and motor 5 are received in the second and third compartment 15 and 16 respectively and positioned by walls 13 and notches

Figure 2:
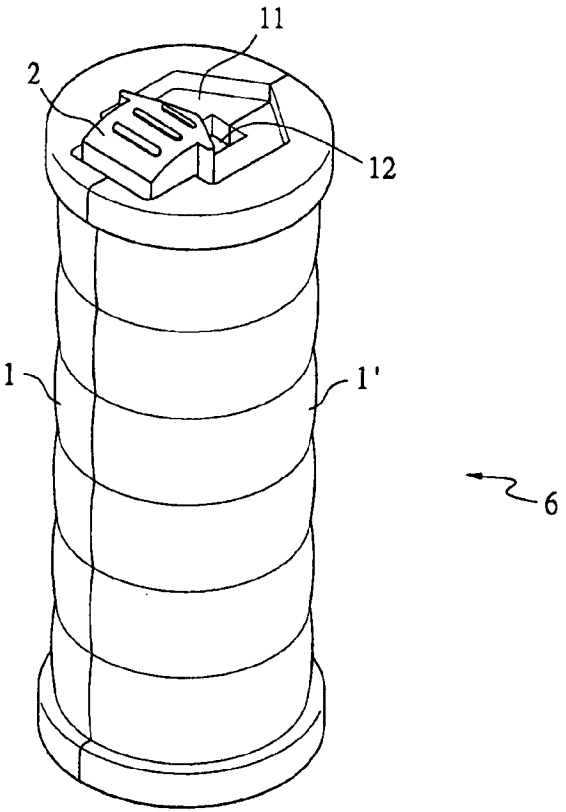
FIG. 2 is a perspective view of the assembled vibrator.

131. A positive terminal of the cell 4 is electrically coupled to a negative terminal of the motor 5. Also, the positive terminal of the motor 5 is electrically coupled to the bottom section 31. Finally, fit the sleeve 142 and bar 163 of the second shell 1' on the bar 141 and sleeve 162 of the first shell 1 respectively to complete the assembly of the vibrator 6, as shown in FIG. 2.

Figure 4:
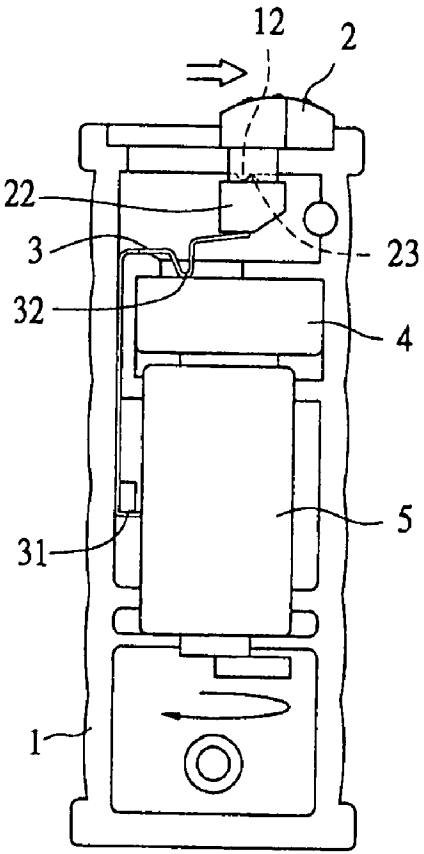
FIGS. 3 and 4 are sectional views of the vibrator in non-operating and operating positions respectively.

In operation, slide the switch 2 horizontally from the position shown in FIG. 3 (i.e., off) to the position shown in FIG. 4 (i.e., on). The projections 23 will pass and then lay against the rib 12 for fastening the switch 2 in this position with the upper recess 32 being pressed to contact the negative terminal of the cell 4 (i.e., a circuit is formed for energizing the motor 5 to rotate for causing the vibrator 6 to vibrate). According to the position by the projections 23 of the switch 2 and the rib 12, the switch 2 can be prevented being turned on or off accidentally.

Furthermore, because the direction of application of force is horizontal, it can prevent the combined first and second shells from detaching when pushing the switch.

Figure 5:
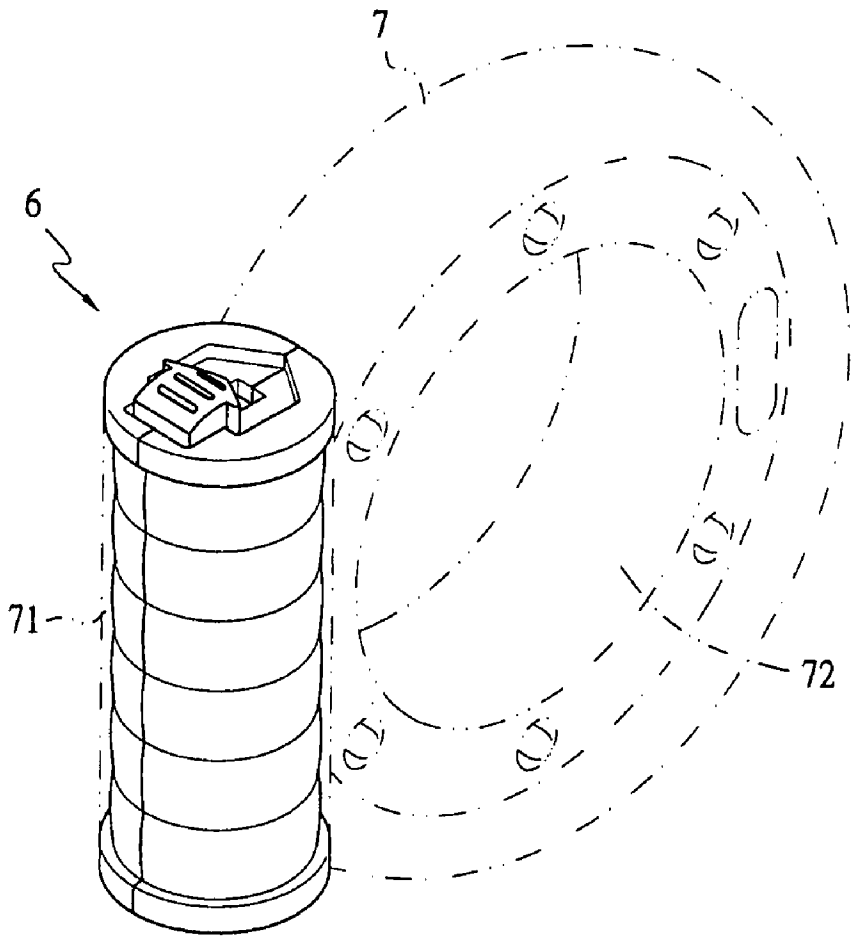
FIG. 5 is an environmental view of the vibrator being mounted in a ring shown in phantom lines.

Referring to FIG. 5, the vibrator 6 can be mounted in a receptacle 71 at an edge of a flexible ring 7. In use, tightly put an inner peripheral surface 72 of the ring 7 on the penis of a male. Next, turn on the vibrator 6 to stimulate vulva of a female in intercourse. This has the benefits of increasing sexual feelings or desires in intercourse, improving impotence, and more.

While the invention herein disclosed has been described by means of specific embodiments, numerous modifications and variations could be made thereto by those skilled in the art without departing from the scope and spirit of the invention set forth in the claims.

What is claimed is:

1. A vibrator being mountable in a sex toy and comprising a housing consisting of two halves coupled together by means of a snapping mechanism, one or more cells and a motor, wherein:

a cavity on the top of the housing comprising a gap on its middle section and a rib on its underside;

a plurality of walls for dividing an internal space of the housing into a first compartment, a second compartment, and a third compartment, wherein any two adjacent compartments are communicated through a notch;

a sliding switch comprising a top knurled button disposed on the cavity, an intermediate narrow section inserted into the gap, and a bottom section disposed in the first compartment, the bottom section having two opposite top projections formed on a shoulder between itself and the narrow section;

anchoring means formed on an inner wall of the second compartment;

an conductive, flexible interconnection comprising an upper contacting section having a portion urged against an inclined portion on the bottom section of the switch in a non-operating position, and a main section fastened by the anchoring means;

the cells being coupled in series and disposed in the second compartment; and the motor being disposed in the third compartment and having a positive terminal electrically coupled to the interconnection and a negative terminal electrically coupled to the positive terminal of the proximate cell, whereby sliding the switch from the non-operating position to an operating position will press the contacting section to contact a negative terminal of the below cell for forming a circuit to energize the motor and engage the projections with the rib for fastening the switch.

2. The vibrator of claim 1, wherein the snapping mechanism comprises a first bar, an opposite first sleeve with the first bar received therein both in the first compartment, a second bar, and an opposite second sleeve with the second bar received therein both in the third compartment.

3. The vibrator of claim 1, wherein the anchoring means comprises a longitudinal stopper formed on the inner wall of the second compartment, the stopper having a longitudinal trough, and a protrusion formed on an inner wall of the third compartment below the projection by a distance.

4. The vibrator of claim 3, wherein the main section of the interconnection comprises a bent bottom urged against the protrusion.

* * * * *